US008491065B2

(12) United States Patent
Eric et al.

(10) Patent No.: US 8,491,065 B2
(45) Date of Patent: Jul. 23, 2013

(54) SHOWCASE-FORMING CABINET WITH LOCKING FOR AT LEAST ONE SLIDING GLASS DOOR

(75) Inventors: Bourgain Eric, Paris (FR); Masson Jean-Jacques, Fontenay Sous Bois (FR); Martin Christophe, Tremblay en France (FR)

(73) Assignee: Adler S.A.S., Moussy-le-Neuf (FR)

( * ) Notice: Subject to any disclaimer, the term of this patent is extended or adjusted under 35 U.S.C. 154(b) by 273 days.

(21) Appl. No.: 12/917,888

(22) Filed: Nov. 2, 2010

(65) Prior Publication Data

US 2011/0266931 A1 Nov. 3, 2011

(30) Foreign Application Priority Data

Nov. 2, 2009 (FR) ..... 09 57732

(51) Int. Cl.
*A47F 3/00* (2006.01)

(52) U.S. Cl.
USPC ..... 312/139.2; 312/304

(58) Field of Classification Search
USPC ..... 312/138.1, 139.2, 304, 299; 49/449, 49/451, 458
See application file for complete search history.

(56) References Cited

U.S. PATENT DOCUMENTS

| | | | | |
|---|---|---|---|---|
| 2,447,219 | A * | 8/1948 | Vanderveld | 70/82 |
| 3,401,994 | A * | 9/1968 | Diack | 312/139.2 |
| 4,036,541 | A * | 7/1977 | Kantor | 312/139.2 |
| 4,741,186 | A * | 5/1988 | Martin | 70/100 |
| 4,875,349 | A * | 10/1989 | Girard | 70/95 |
| 8,182,052 | B2 * | 5/2012 | Bourgain et al. | 312/139.2 |
| 2001/0030606 | A1 * | 10/2001 | Jaffe et al. | 340/545.6 |
| 2007/0236111 | A1 * | 10/2007 | Gray | 312/138.1 |
| 2009/0151405 | A1 * | 6/2009 | Bourgain et al. | 70/78 |

FOREIGN PATENT DOCUMENTS

| | | |
|---|---|---|
| DE | 103 23 696 | 12/2004 |
| EP | 1 640 537 | 3/2006 |
| FR | 2 868 106 | 9/2005 |
| FR | 2 923 251 | 5/2009 |

OTHER PUBLICATIONS

Preliminary Search Report corresponding to the European FR/0957732 application.

* cited by examiner

*Primary Examiner* — Hanh V Tran
(74) *Attorney, Agent, or Firm* — Kilpatrick Townsend & Stockton LLP

(57) ABSTRACT

A cabinet forming a showcase is provided and includes at least one glass door fastened on a ferrule moving along a rail, and a latch housed in the structure of the cabinet. When the door is in a locking position, the bolt of the latch is engageable in a notch formed in the ferrule or in an endpiece mounted at the end of said ferrule. This notch-includes an internally chamfered wall with a rake angle to prevent the bolt from returning to the retracted position under the effect of movement transmitted via the door as a result of residual slack between the ferrule and the rail.

13 Claims, 2 Drawing Sheets

FIG.1
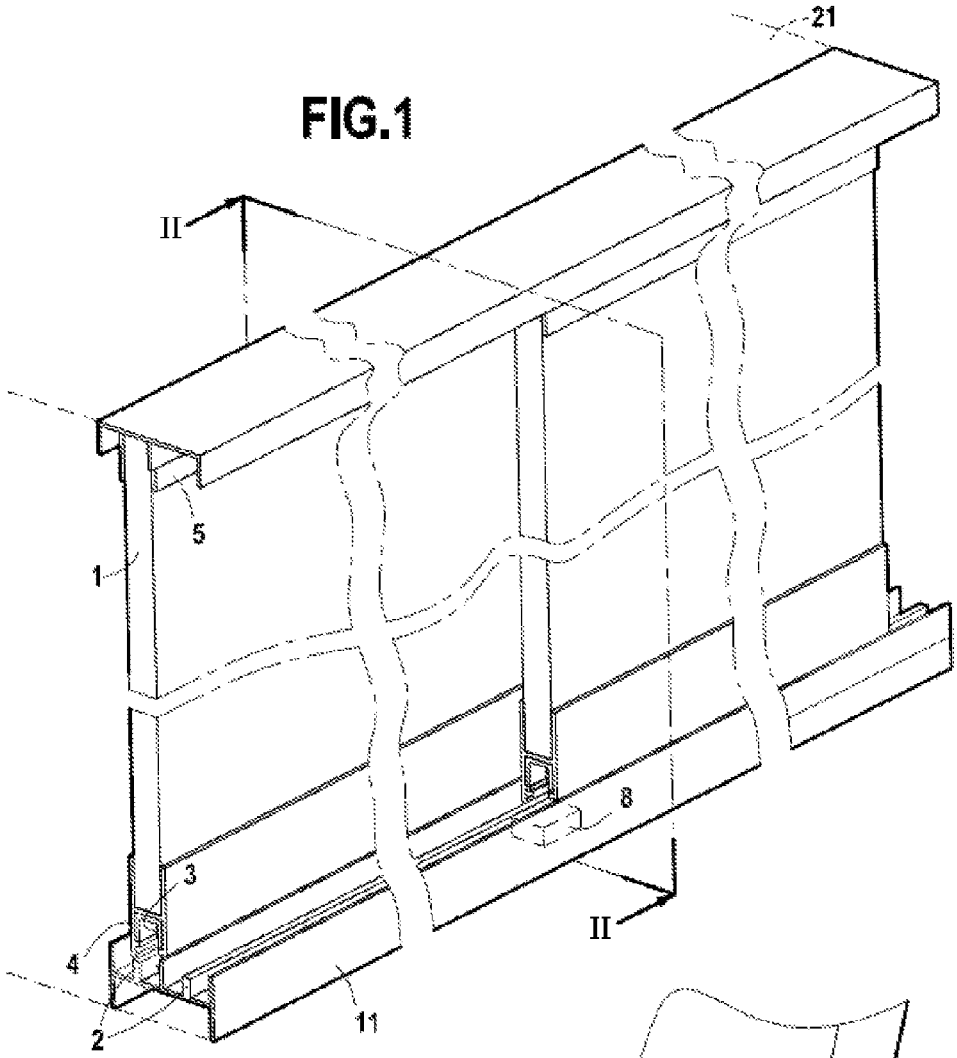
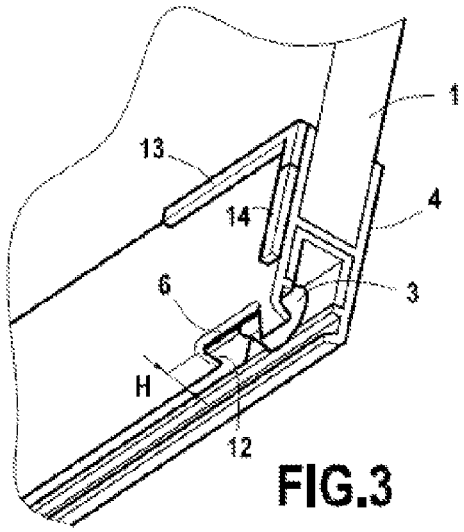
FIG.3

SHOWCASE-FORMING CABINET WITH LOCKING FOR AT LEAST ONE SLIDING GLASS DOOR

FIELD OF THE INVENTION

The invention relates to a locking system for sliding glass doors of a showcase-forming cabinet. More particularly, the invention relates to a system enabling two sliding glass doors of a showcase-forming cabinet to be locked simultaneously.

BACKGROUND OF THE INVENTION

Manual locking systems are already known for cabinets, which systems are in the form of conventional mechanical locks. Electromagnetic closures are also known comprising an electromagnet and a movable element that locks the door when the latch is moved electrically. The advantage of electromagnetic systems is that they enable locking to be verified by defining an electrical monitor circuit. One such system is described for example in patent FR 2 868 106.

In patent application FR 2 923 251, proposals are made for an improvement of that type of closure. In particular, the improvement relates to a showcase-forming cabinet having at least one glass door fastened on a ferrule that moves along a rail, and a latch of electromagnetic type housed in the structure of the cabinet and arranged in such a manner that the bolt of the latch can co-operate with a notch formed in the ferrule when the door is in the locking position. The notch and the bolt of the latch have walls that are smooth and substantially parallel. In similar manner, in a showcase-forming cabinet that has two doors, each moving along a respective rail, the latch is housed between the two rails and is capable of co-operating with the notch in each of the ferrules when the doors are in the locking position.

Given that it is undesirable to continue powering the electromagnet throughout the time that the two doors of the showcase are locked together, the bolt is held in position in the notch by friction forces that are relatively weak. Under the effect of the slack that may exist between the rail and the doors (in particular due to the bearings and the ferrules), when a vertical force is applied to said doors, it is possible to wedge the bolt and then make it move down together with the doors, thereby retracting it over a length that is equal to the existing slack. By repeating these operations, it is possible to retract the bolt sufficiently to release the doors.

OBJECT AND SUMMARY OF THE INVENTION

The present invention seeks to remedy that drawback, and an object of the invention is to create a system for locking at least one sliding glass door of a showcase-forming cabinet, using a single latch that provides its user with good security by making it tamperproof while also being easy to implement.

More particularly, the present invention provides a cabinet forming a showcase, including at least one glass door fastened on a ferrule moving along a rail, and a latch housed in the structure of the cabinet in such a manner that the bolt of the latch is engageable, when the door is in a locking position, in a notch formed in the ferrule or in an endpiece mounted at the end of said ferrule, wherein the notch includes an internally chamfered wall with a rake angle to prevent the bolt from returning to the retracted position under the effect of movement transmitted via the door as a result of residual slack between the ferrule and the rail.

Advantageously, the rake angle relative to the vertical is about 15°, and is preferably close to 20°.

According to a characteristic of the invention, the bolt of the latch comprises a cylindrical body with a head of greater diameter.

In another embodiment of the invention, the cabinet has two glass doors, each movable along a respective rail, the latch being housed between the two rails and being capable of co-operating simultaneously with said notch in each of the ferrules or endpieces when the doors are in the locking position.

According to another characteristic of the invention, when the doors are in the locking position, each of the facing side walls of a ferrule or an endpiece includes an L-shaped projecting rib, the L-shaped ribs engaging one in the other, each rib being positioned over the notch in each ferrule so as to protect the latch.

According to yet another characteristic of the invention, each facing side wall of the ferrule or of the endpiece includes indexing means for indexing one door relative to the other to so as to cause the doors to coincide in order to facilitate the locking operation.

BRIEF DESCRIPTION OF THE DRAWINGS

The invention can be better understood and other advantages thereof appear better in the light of the following description given purely by way of example and made with reference to the accompanying drawings, in which:

FIG. 1 is a perspective view of two sliding glass doors in the locked position of a cabinet of the present invention;

FIG. 3 is a perspective view from beneath of the mounting of a sliding glass door of the present invention, and of the notch enabling it to be locked.

MORE DETAILED DESCRIPTION

Figure 4:
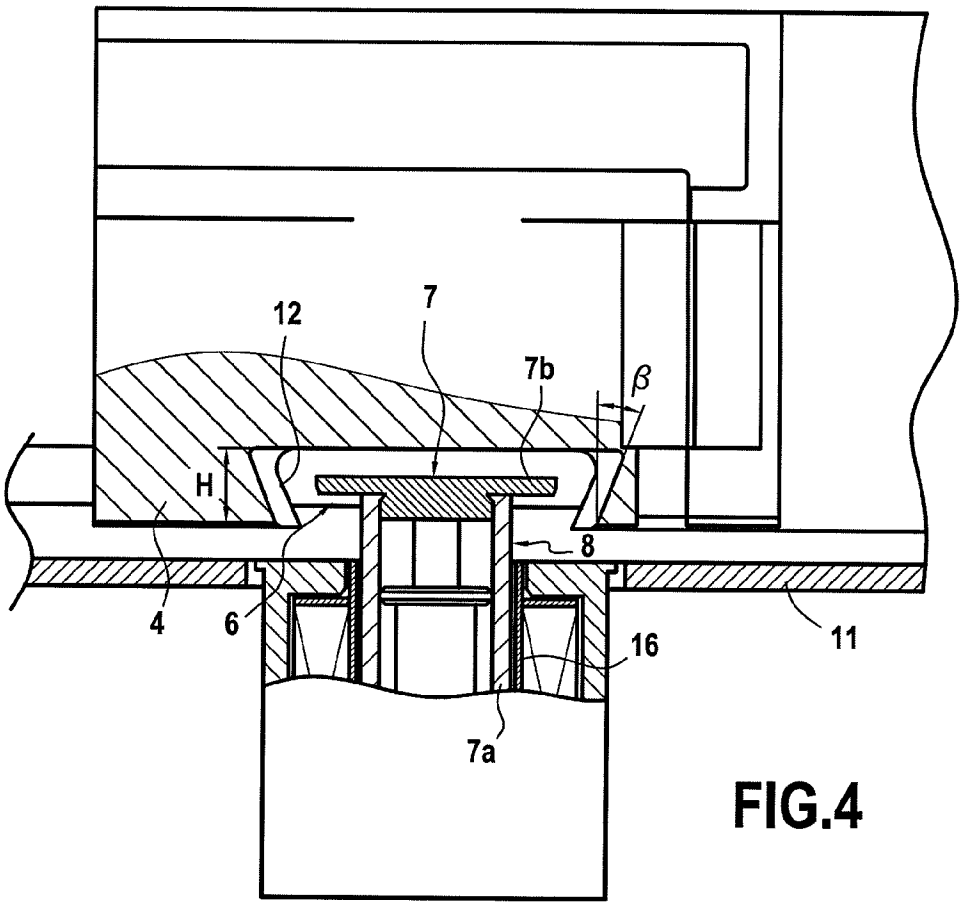
FIG. 4 is a fragmentary section view on line IV-IV of FIG. 2, showing the bolt co-operating with the notch of the invention, the glass doors being in the locking position.

With reference to the figures, there can be seen two adjacent sliding glass doors 1 of a cabinet 21 forming a showcase, the doors being capable of moving along respective rails 2. The doors are mounted to slide on the rail by means of wheels 3 inserted in and crimped to ferrules 4 in the form of H-shaped section members. The bottom portion of each door is rabbeted in such a ferrule 4 e.g. by silicone adhesive, or by clamping, or by any other suitable means. Advantageously, the ferrule, finished off by an endpiece, occupies the entire length of the door. In its top portion, each door is merely guided in a ferrule 5 of channel section. Each ferrule 4 presents in its bottom portion a notch 6 facing towards the adjacent rail. An electromagnetic latch 8 is housed in the bottom structure 11 of the cabinet 21, between said rails. When the latch 8 is operated electrically, its bolt 7 moves vertically in its guide cylinder 16 until it comes to co-operate simultaneously with the respective notches 6 in each of the ferrules. The bolt 7 engages in both notches 6 and prevents both doors from moving.

The ferrule 4, shown in greater detail in FIG. 3 presents the notch 6 in its bottom portion, which notch has a chamfered inside wall 12 with a rake angle β suitable for preventing the bolt 7 from being returned into a retracted intermediate position by exerting lateral and vertical movements on the door, as made possible by the need for residual slack between the ferrules and the rail. For this propose, the rake angle needs to flare considerably. For example, this flare is represented by the angle β formed between the thickness of the inside edge of the notch and a vertical axis. This angle may be of the order of 15°, or even 20° for security. In any event, the angle β is greater than 12° in order to ensure irreversibility. Furthermore, it is preferable for the height (H) of the chamfered inside wall 12 of the notch 6 to be greater than the amplitude through which the door 1 can move.

Figure 2:
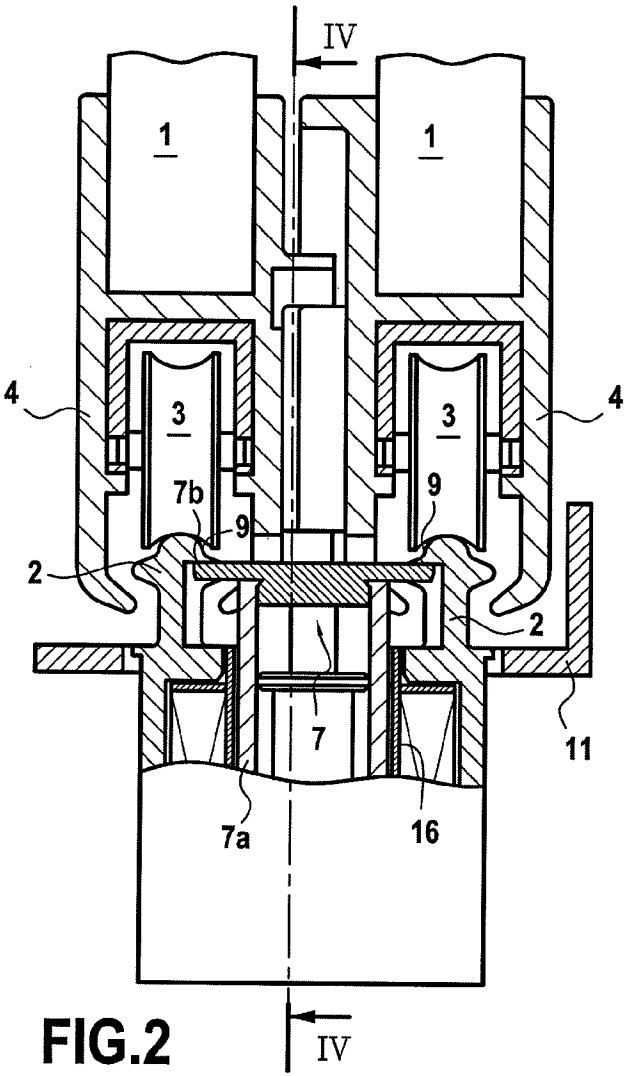
FIG. 2 is a fragmentary section view on line II-II of FIG. 1, showing a cabinet with two sliding glass doors of the present invention, the doors being in the locking position.

Advantageously, the bolt 7 is mushroom-shaped, as shown in FIG. 4, presenting a cylindrical body 7*a* and a head 7*b* that is partially cylindrical or conical and of diameter that is greater than the diameter of the cylindrical body. By having a bolt of this shape, when the door is shaken, any contact between the notch 6 and the bolt 7 necessarily takes place via the sloping inside wall 12 of the notch 6 and via one end of the head 7*b*. Since the friction forces present during such contact are oriented perpendicularly to the chamfered wall 12, the bolt 7 is prevented from being blocked in an intermediate position and the bolt cannot move down into the guide cylinder 16 of the latch. In the presence of a head 7*b* of conical shape, electrical contact between the head 7*b* of the bolt 7 and the head 9 of the rail 2, as shown in FIG. 2 is improved, where such contact is suitable for closing an electric circuit that serves to identify that one or more sliding doors are locked.

Each of the ferrule side walls that face each other in the locking position includes a respective L-shaped projecting rib 13. Each rib 13 is positioned above the notch 6 in each ferrule so as to protect the latch 8. With reference to FIG. 2, one of the ferrules, e.g. the front member of the showcase, includes a first L-shaped rib 13 with its longer branch flush with the top edge of said ferrule and with its shorter branch flush with the end of said member. The rear member has a second L-shaped rib (not shown) that is geometrically similar to and smaller than the first rib 13. When the doors are in the locked position, the second rib takes up a position beneath the first rib 13, and the shorter branch of the L-shape of the second rib is suitable for coming into abutment against the longer branch of the L-shape of the first rib 13. In the locked position, when both ferrules 4 face each other, a double baffle is thus constituted so as to make the bolt 7 of the latch 8 inaccessible. This ensures that the latch is mechanically tamperproof.

Each of the side walls of the ferrules or of the endpieces that face one another also includes index means 14 for indexing one door relative to the other so as to cause the doors to coincide relative to each other and thus simplify the operation of locking or unlocking. The indexing means may be a positioning magnet, preferably in the form of a strip disposed vertically at the end of the ferrule 4 or at the end of its endpiece. This makes it possible to ensure that the two notches 6 are in the appropriate relative position and to facilitate penetration or retraction of the bolt 7 without hindrance whenever the sliding door is operated to open or close. This indexing may present an advantage in terms of ergonomics and of quality since it assists in ensuring that the doors are fully locked together. Furthermore, the projecting ribs 13 may be used as additional indexing means to constitute mechanical abutments for further reinforcing the security of locking. Preferably, the indexing means constitute an integral portion of the shorter branches of the L-shapes of the ribs 13.

By means of the invention, and in particular by means of the shapes of the notch and of the corresponding bolt, vertical locking of one or two sliding doors is made safe. The notch and the bolt of the invention are also applicable when locking between two sliding doors is horizontal, the bolt passing through the first door and engaging in the second. Finally, the invention may be found to be of use for horizontally locking a single sliding glass door.

In a variant of these embodiments, the top portion of the door may also be mounted in a ferrule, and the lock may be housed in the top structure of the cabinet, said lock then being capable of co-operating with a notch formed in said top ferrule.

What is claimed is:

1. A cabinet forming a showcase, including at least one glass door fastened on a ferrule moving along a rail, and a latch housed in the structure of the cabinet in such a manner that a bolt of the latch is engageable, when the door is in a locking position, in a notch formed in the ferrule or in an endpiece mounted at the end of said ferrule, wherein the notch includes an internally chamfered wall with a rake angle to prevent the bolt from returning to the retracted position under the effect of movement transmitted via the door as a result of residual slack between the ferrule and the rail.

2. A showcase-forming cabinet according to claim 1, wherein the rake angle relative to the vertical is about 15°.

3. A showcase-forming cabinet according to claim 1, wherein the height of the chamfered inside wall of the notch is greater than the amplitude through which the door can move.

4. A showcase-forming cabinet according to claim 1, wherein the bolt of the latch comprises a cylindrical body with a head of greater diameter.

5. A showcase-forming cabinet according to claim 1, having two glass doors, each movable along a respective rail, the latch being housed between the two rails and being capable of co-operating simultaneously with said notch in each of the ferrules or endpieces when the doors are in the locking position.

6. A showcase-forming cabinet according to claim 5, wherein, when the doors are in the locking position, each of the facing side walls of a ferrule or an endpiece includes an L-shaped projecting rib, the L-shaped ribs engaging one in the other, each rib being positioned over the notch in each ferrule so as to protect the latch.

7. A showcase-forming cabinet according to claim 5, wherein one of the ferrules or endpieces includes a first L-shaped rib having its longer branch flush with the top edge of said ferrule or said endpiece, and having its shorter branch flush with the end of said ferrule or said endpiece.

8. A showcase-forming cabinet according to claim 7, wherein the other ferrule or endpiece has a second L-shaped rib geometrically similar to and smaller than the first rib, in that, in the locking position of the doors, said second rib is suitable for being positioned under the first rib, and wherein the shorter branch of the L-shape of the second rib is suitable for coming into abutment against the shorter branch of the L-shape of the first rib.

9. A showcase-forming cabinet according to claim 5, wherein each facing side wall of the ferrule or of the endpiece includes indexing means for indexing one door relative to the other to so as to cause the doors to coincide in order to facilitate the locking operation.

10. A showcase-forming cabinet according to claim 9, wherein the indexing means comprise a positioning magnet.

11. A showcase-forming cabinet according to claim 9, wherein the indexing means are disposed vertically at the end of the ferrule or the endpiece and constitute an integral portion of the shorter branch of the corresponding rib.

12. A showcase-forming cabinet according to claim 1, wherein the rake angle relative to the vertical is close to 20°.

13. The showcase-forming cabinet according to claim 10, wherein the positioning magnet is in the form of a strip.

* * * * *